US006978775B2

(12) United States Patent
Graf

(10) Patent No.: US 6,978,775 B2
(45) Date of Patent: Dec. 27, 2005

(54) ARROW REST SYSTEM AND METHOD

(75) Inventor: Stephen Charles Graf, Pittsboro, NC (US)

(73) Assignee: Carolina Archery Products, Inc., Hillsborough, NC (US)

( * ) Notice: Subject to any disclaimer, the term of this patent is extended or adjusted under 35 U.S.C. 154(b) by 0 days.

(21) Appl. No.: 10/342,751

(22) Filed: Jan. 15, 2003

(65) Prior Publication Data

US 2004/0134474 A1 Jul. 15, 2004

(51) Int. Cl.[7] ..... F41B 5/22
(52) U.S. Cl. ..... 124/44.5
(58) Field of Search ..... 124/24.1, 44.5

(56) References Cited

U.S. PATENT DOCUMENTS 4,282,850 A 8/1981 Warnicke
4,351,311 A 9/1982 Phares
4,372,282 A 2/1983 Sanders
4,759,337 A 7/1988 Suski
4,858,589 A 8/1989 Chang
4,917,072 A 4/1990 Chang
5,042,450 A 8/1991 Jacobson
5,253,633 A 10/1993 Sisko
5,456,242 A 10/1995 Ruholl
5,460,153 A 10/1995 Huntt
5,685,287 A 11/1997 Greywall
5,896,849 A 4/1999 Branthwaite et al.
5,960,779 A 10/1999 Jessee et al.
RE38,096 E 4/2003 Branthwaite et al.

*Primary Examiner*—John A. Ricci
(74) *Attorney, Agent, or Firm*—Kilpatrick Stockton LLP

(57) ABSTRACT

Systems and methods for providing an arrow rest are disclosed. The arrow rest includes a frame defining an orifice. The frame has a first surface, a second surface and a slot. The orifice has a first axis. A ring is coupled with the second surface of the frame. The frame is adapted to receive the ring.

35 Claims, 10 Drawing Sheets

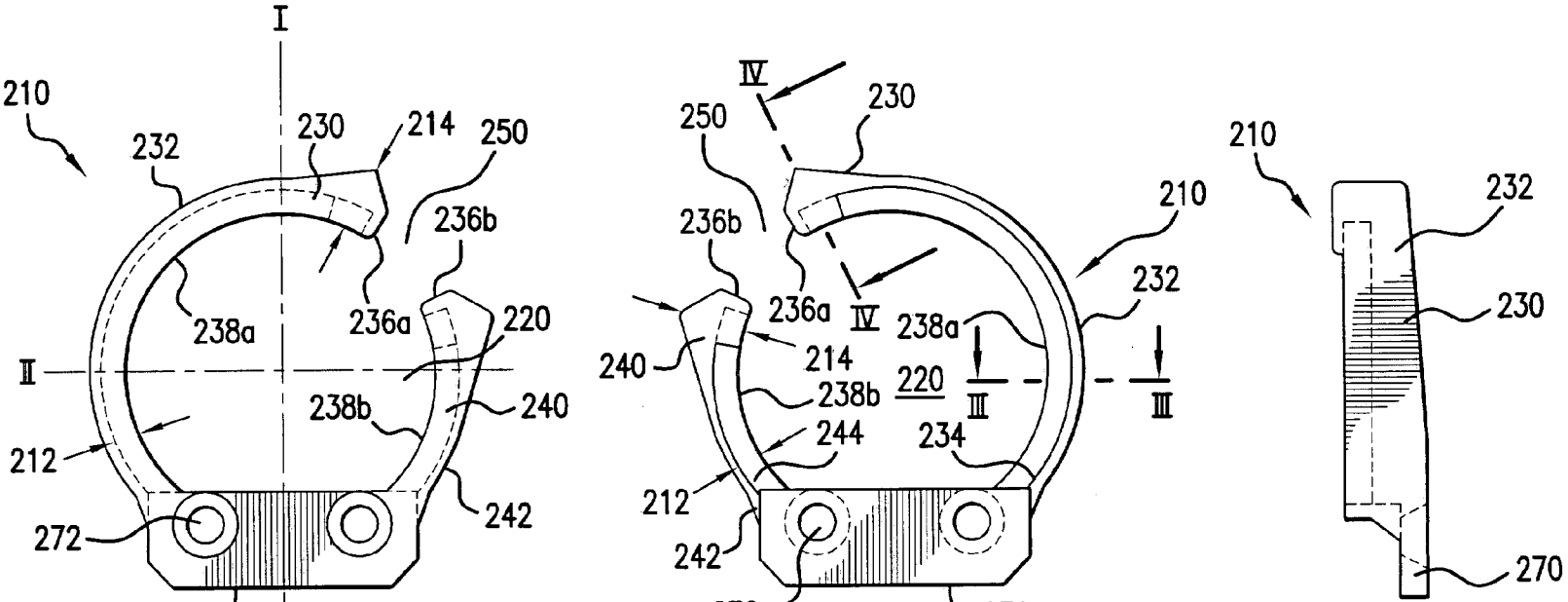
FIG.2
FIG.3
FIG.4
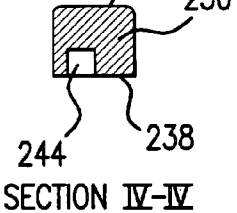
SECTION IV-IV
FIG.6
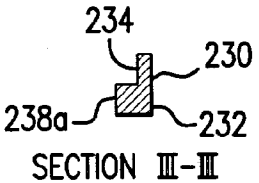
SECTION III-III
FIG.5

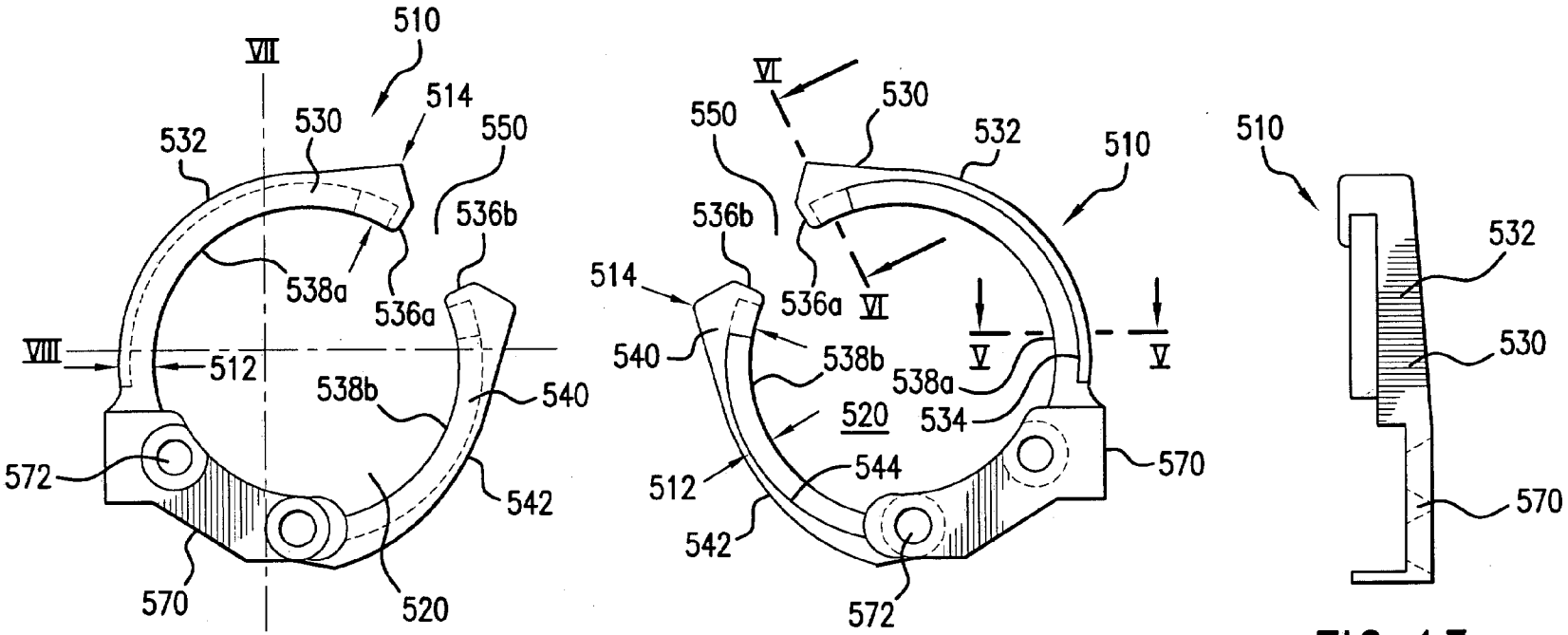
FIG. 11
FIG. 12
FIG. 13
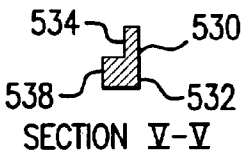
FIG. 14
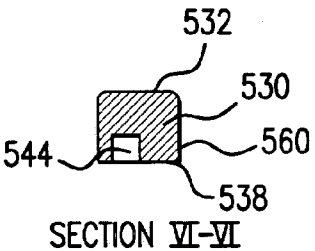
FIG. 15

ARROW REST SYSTEM AND METHOD

NOTICE OF COPYRIGHT PROTECTION

A portion of the disclosure of this patent document and its figures contain material subject to copyright protection. The copyright owner has no objection to the facsimile reproduction by anyone of the patent document, but otherwise reserves all copyrights whatsoever.

FIELD OF THE INVENTION

The invention generally relates to archery equipment and, more particularly, to an arrow rest.

BACKGROUND

Many arrow rests are known to support an arrow prior to and after release. The most basic rest is a flat or angular surface. Rests attempt to minimize the amount of friction with the arrow to prevent damage to the arrow shaft or fletching (feathers) and to increase the reliability of each shot. Minimizing the restraint of the arrow, however, can result in the arrow slipping from the rest when the bow is tilted or rotated radially or when drawing an arrow, which is often the case during hunting.

Some rests attempt to provide radial support to the arrow shaft to prevent the arrow from slipping when tilting or rotating the bow. Most of these devices, however, impart severe frictional resistance to the passage of the arrow unless the fletching is oriented rather precisely to the radial openings in the arrow rest. Other devices, such as that described in U.S. Pat. No. 5,896,849, assigned to the assignee of the present invention, address such problems. Yet, even such reduced frictional resistance may be sufficient to cause some arrows—for example, expanding broad heads, which expand when striking a target—to expand while being loaded into the arrow rest. Thus, loading expanding broad head arrows into these devices requires caution, which likely requires additional time and care to load.

Furthermore, in some devices, proximity of an arrow head to the bow string when loading an arrow can result in damage to the bow string. Thus, loading an arrow into such a rest requires caution, which, again, likely requires additional time to load.

Ring-type arrow rests having a radially disposed slot that permit an arrow to be side-loaded are known. Because a segment of the support ring is removed to form the slot, these devices lack the strength and flexural stability of a continuous support ring. The lack of dimensional stability of the rest that results from this reduced strength and flexural stability may reduce the accuracy and reliability of each shot.

SUMMARY OF THE INVENTION

The present invention comprises systems and methods for providing a frame for an arrow rest having an entry slot. Embodiments of the present invention may take a wide variety of forms. In one exemplary embodiment, an apparatus includes a frame defining an orifice. The frame has a first surface, a second surface and a slot. The orifice has a first axis. A ring is coupled with the second surface of the frame. The frame is adapted to receive the ring.

In another exemplary embodiment, a method includes providing an orifice defined by a frame. The frame has a first axis and includes a first surface, a second surface, and a slot.

The method also includes coupling a ring to the second surface of the frame. The frame is adapted to accept the ring.

In a further exemplary embodiment, a system includes an archery bow, a base member coupled to the bow, and an arrow rest coupled to the base member. The arrow rest includes a frame and a ring. The frame is adapted to accept the ring. The frame defines an orifice having a first axis. The frame includes a first surface, a second surface, and a slot. The ring of the arrow rest is coupled with the second surface of the frame.

In yet another exemplary embodiment, an apparatus includes a frame defining an orifice having a first axis. The frame is adapted to receive a ring. The frame includes a first surface, a second surface and a slot.

An advantage of the present invention can be to permit loading of an arrow from a side of an arrow rest.

Another advantage of the present invention can assist in providing further support to an arrow prior to and during release of the arrow.

Yet another advantage of the present invention can be to reduce the frictional resistance imparted to an arrow during loading.

A further advantage of the present invention can be to reduce the noise resulting from loading an arrow into an arrow rest.

These exemplary embodiments are mentioned not to summarize the invention, but to provide an example of an embodiment of the invention to aid understanding. Exemplary embodiments are discussed in the Detailed Description, and further description of the invention is provided there. Advantages offered by the various embodiments of the present invention may be understood by examining this specification.

BRIEF DESCRIPTION OF THE DRAWINGS

The accompanying drawings, which constitute part of this specification, help to illustrate embodiments of the invention. In the drawings, like numerals are used to indicate like elements throughout.

FIG. 2 is an elevation view of a frame of the arrow rest shown in FIG. 1.

FIG. 3 is another elevation view of the frame of the arrow rest of FIG. 2.

FIG. 4 is a side view of the frame of the arrow rest of FIG. 2.

FIG. 5 is a cross-sectional view along the line III—III of FIG. 3.

FIG. 6 is a cross-sectional view along the line IV—IV of FIG. 3.

FIG. 11 is an elevation view of another embodiment of a frame of an arrow rest for a left-handed application according to the present invention.

FIG. 12 is another elevation view of the frame of the arrow rest shown in FIG. 11.

FIG. 13 is a side view of the frame of the arrow rest shown in FIG. 11.

FIG. 14 is a cross-sectional view of line V—V shown in FIG. 12.

FIG. 15 is a cross-sectional view of line VI—VI shown in FIG. 12.

DETAILED DESCRIPTION

Embodiments of the present invention include systems and methods for providing a frame for an arrow rest allowing an arrow to be loaded from the side of the rest while securely maintaining the arrow in the rest until released. The principles of the present invention described are applicable to both left and right-handed applications. U.S. Pat. No. 5,896,849, assigned to the assignee of the present invention, is incorporated in its entirety herein by reference.

Figure 1:
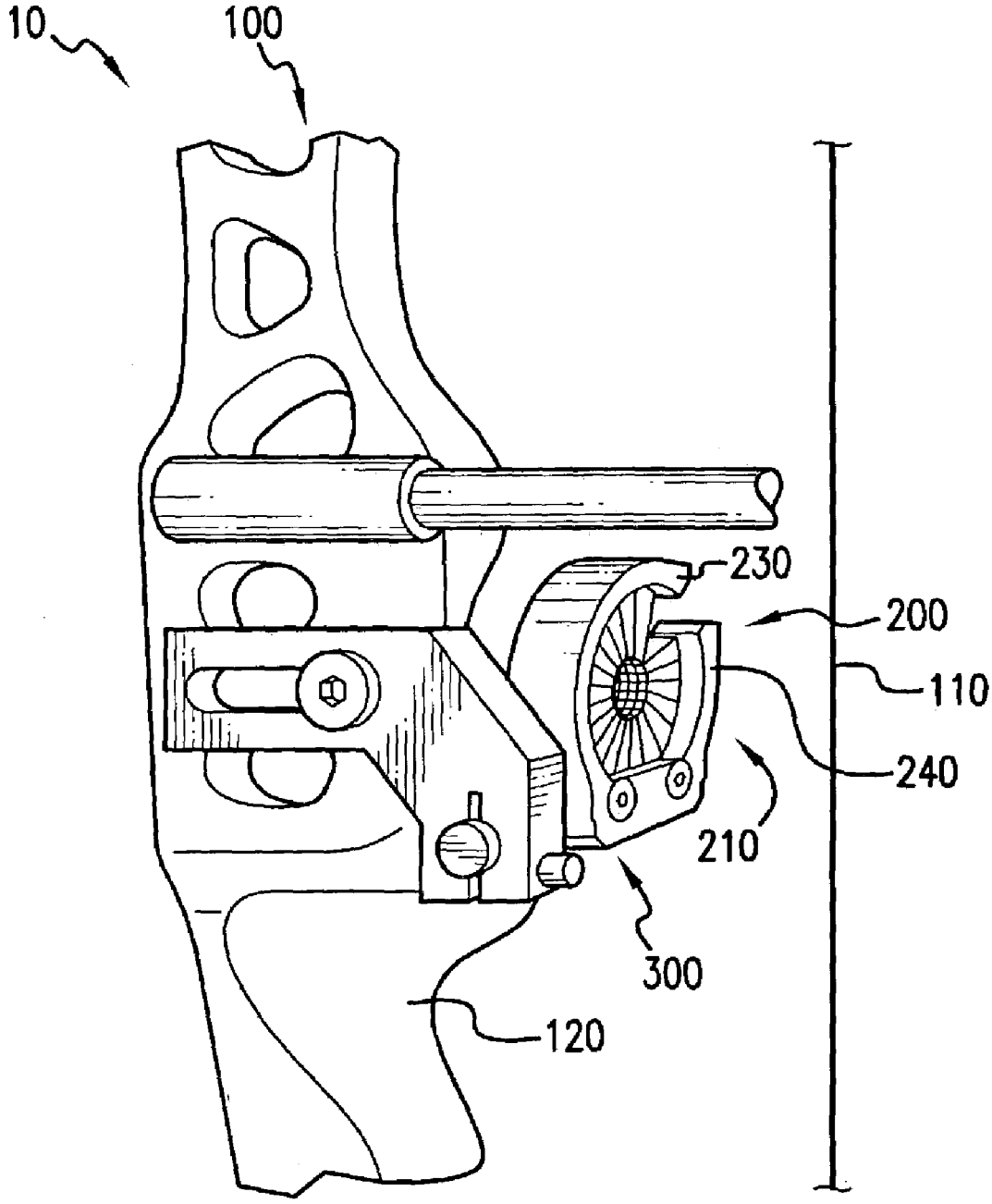
FIG. 1 is a cutaway perspective view of a system according to an embodiment of the present invention for a left-handed application.

FIG. 1 is a cutaway perspective view of a system 10 according to an embodiment of the present invention. The system 10 includes an archery bow 100, an arrow rest 200, and a base member 300. The system 10 shown is preferably used by a left-handed person, but other embodiments are used by right-handed persons. A bow string 110 is disposed behind the arrow rest 200, which will be described in more detail below. The base member 300 is coupled with the bow 100 above a handle 120 of the bow 100. As will be described in more detail below, the rest 200 is coupled with and supported by the base member 300. Terms of position, such as "behind," "above," "front," etc. refer to positions with respect to one handling the bow 100 in a traditional manner.

FIGS. 2 and 3 are elevation views of a frame 210 of the arrow rest 200 shown in FIG. 1. FIG. 4 is a side view of FIG. 2. Referring now to FIGS. 2–4, a frame 210 is shown. Frame 210 defines an orifice 220. The frame 210 includes a first portion 230, a second portion 240, and a base member 270. Frame 210 has a first axis I and a second axis II.

First and second portions 230, 240 are arcuate shaped, and extend from base member 270. First and second portions 230, 240 each have a first surface 232, 242, a second surface 234, 244 ends 236*a*, 236*b* a first ridge surface 238*a*, 238*b* and a second ridge surface 239*a*, 239*b*. A ring (not shown) is coupled with the second surface 234 and the second ridge surface 239. The ring is disposed within the frame 210. Alternatively, any other suitable shape can be used for the first and second portions 230, 240 forming the frame 210. A gap defined by end 236*a* of the first portion 230 and end 236*b* of the second portion 240 form a slot 250. In one embodiment, the first and second portions 230, 240 are displaceable, such that the gap can be adjusted or closed.

Preferably, a sound dampening material is coupled to both ends 236*a*, 236*b*. The sound dampening material minimizes the sound of an arrow contacting frame 210 when being loaded into the rest 200. Preferably, felt is adhered to both ends 236*a*, 236*b*. Alternatively, any other suitable sound dampening material can be molded or formed integrally with ends 236*a*, 236*b*.

In one embodiment, one end of a gate (not shown) is coupled to either the first portion 230 or the second portion 240 and spans the slot 250. For example, the gate is coupled to the second portion 240 by a hinge. After an arrow has been loaded into rest 200, the gate can be closed by coupling another end of the gate to the first portion 230. Alternatively, any other suitable means of closing slot 250 can be used.

Slot 250 is of sufficient width to accommodate a diameter of an arrow. Preferably, the width of slot 250 is approximately 0.40 inches. Alternatively, any other suitable width can be used. Arrow diameters generally vary and the preferred width of slot 250 is sufficient to accommodate most known arrows.

Preferably, slot 250 is disposed at a 45 degree angle from axis II. In one embodiment, slot 250 is disposed substantially planar with axis II. In another embodiment, slot 250 is disposed substantially orthogonal to axis II. Alternatively, slot 250 can be disposed in any other suitable position. Suitable positions generally include those positions in which loading an arrow into slot 250 does not interfere with other aspects of the bow 100. Determining which positions are suitable can also depend on the size of slot 250. A position deemed unsuitable using the preferred width described above may be made suitable by increasing the width of slot 250. The increased width of slot 250 would—when loading—allow an arrow to navigate around the interference or obstruction. Thus, the width and positioning of slot 250 can be varied to accommodate varying bow configurations.

First surfaces 232, 242 and second surfaces 234, 244 and first ridge surfaces 238*a*, 238*b* generally form concentric circles about the intersection of axis I and axis II. A first thickness 212 of first portion 230 defined by a distance between the first surface 232 and the first ridge surface 238*a* is generally uniform throughout frame 210. Proximate the slot 250, the first surface 232 flares. A second thickness 214 is defined by a distance between the first surface 232 and the first ridge surface 238*a* proximate slot 250. Thus, a second thickness 214 of the frame 210, proximate slot 250, is greater than the first thickness 212. A similar configuration is present for second portion 240.

Removing a portion of a frame generally reduces the strength and flexural stability of the frame. The increased thickness of frame 210 proximate slot 250 provides additional strength and flexural stability to frame 210 similar to that exhibited by a frame that is continuous, i.e., a frame without a slot. Additionally, the increased thickness of frame 210 proximate slot 250 helps guide an arrow into proper position in rest 200.

Base element 270 of frame 210 is generally rectangular shaped. A major axis (not shown) of the base element 270 is substantially parallel to axis II. Base element 270 is not limited to that shown here. Any other suitable shape and configuration can be used. Disposed in the base element 270 are two orifices 272, which are adapted to accept a fastening element, such as a screw or any other suitable fastener. Any other suitable number of orifices can be used.

Figure 6A:
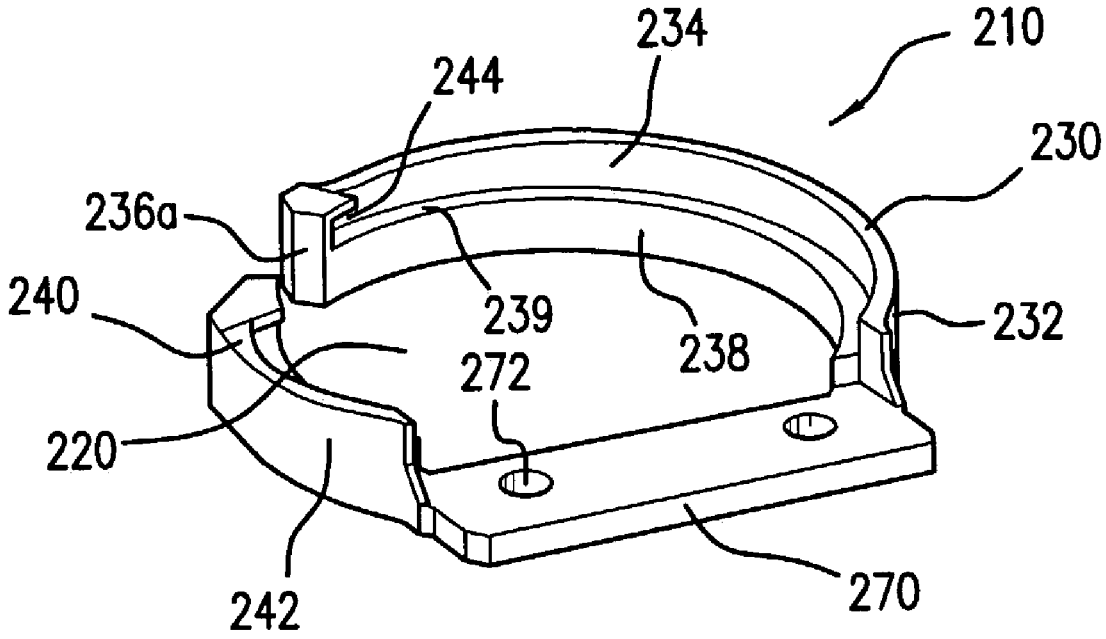
FIG. 6A is a detail view of the frame of FIG. 3.

Referring now to FIGS. 5 and 6, cross-sections along lines III—III and IV—IV in FIG. 3 are shown. Although shown on first portion 230, similar detail is present on second portion 240. Disposed on first portion 230 proximate the end 236 is recess 244. FIG. 6A is a perspective view of FIG. 3 showing a detail of recess 244. Although shown with respect to first portion 230, a recess (not shown) is also disposed in a similar configuration on second portion 240. Recess 244 is disposed proximate end 236*a* and is defined by second surface 234 and second ridge surface 239*a*. Recess 244 is adapted to receive ring 260 and provides contact for a terminal end (not shown) of the ring 260. Recess 244 helps restrict displacement of the ring 260, and thus, provides ring 260 with dimensional stability. Furthermore, recess 244 helps prevent an arrow from contacting ring 260.

Frame 210 preferably is made of a polymer material. In one embodiment, the polymer material of frame 210 includes a glass-filled nylon. In another embodiment, fiberglass is present in the frame 210 in an amount of approximately 30 percent by weight. Alternatively, the frame 210 can be formed of any other suitable material. Preferably, the frame 210 is injection molded. Alternatively, the frame 210 can be formed by any other suitable method, such as by machining or stamping.

Figure 7:
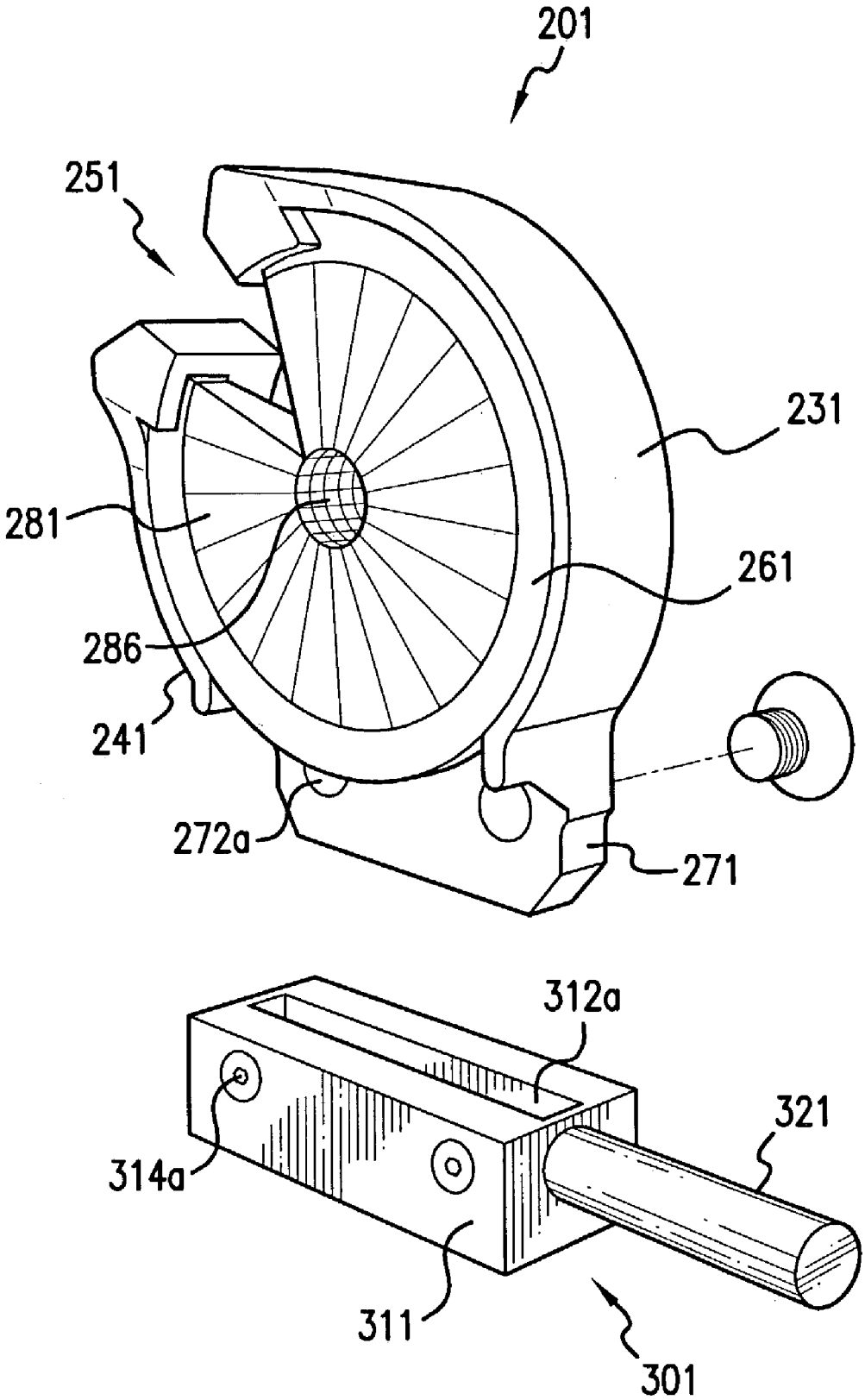
FIG. 7 is an exploded perspective view of an arrow rest and base member for a right-handed application according to an embodiment of the present invention.

Referring now to FIG. 7, an exploded perspective view of arrow rest 201 and base member 301 is shown. Rest 201 is suitable for use for right-handed applications. A pliable member 281 is disposed in orifice 220. The pliable member 281 is coupled with the ring 261 and projects radially inward. The pliable member 281 forms a substantially closed aperture 286. The term "closed" refers to a perimeter formed by the aperture 286 that is generally continuous. Most preferably, there is a small gap or opening in the perimeter of the aperture 286. Preferably there is no clearly visible gap or opening in the perimeter of the aperture 286. In either case, an arrow shaft would not likely be able to escape the aperture 286 by ordinary movement or rotation of bow 100.

Preferably, the aperture 286 forms a circle. Preferably, a diameter of the aperture 286 is slightly larger than a diameter of an arrow shaft so that the pliable member 281 substantially supports the surface of the arrow shaft. Alternatively, the diameter of the aperture 286 corresponds to the diameter of the arrow shaft so that the pliable member 281 substantially supports the entire surface of the shaft.

The gap formed by slot 251 causes the pliable member 281 to taper toward the aperture 286. This taper allows an arrow shaft to be inserted into the aperture 286 of the rest 201 with little resistance offered by pliable member 281. Likewise, the taper supports the arrow in the aperture 286 with a relatively large force required to dislodge the arrow from the aperture 286—that is, a force greater than that experienced by normal movement and rotation of bow 100.

Preferably, the pliable member 281 includes a plurality of bristles. The bristles of pliable member 281 are formed from a synthetic polymer or any other suitable material of sufficient strength and resiliency to withstand repeated deflection by an arrow being projected through the rest 201. Preferably, the thickness of each individual bristle is approximately 0.010 inches. Alternatively, any other suitable bristle thickness can be used.

Base member 301 includes a supporting member 311 and a linkage 321. The supporting member and the linkage are formed as a unitary whole. Alternatively, the supporting member 311 and the linkage 321 can be formed of separate components and coupled together. The supporting member 311 includes a trench 312*a* and orifices 314*a*. The trench 312*a* is adapted to receive a portion of ring 261. Base element 271 of frame 211 rests on and is coupled to a portion of base member 301. Alternatively, base member 301 can be coupled with rest 201 using any other suitable means or configuration.

Linkage 321 is coupled with the bow 100 by a fastening element (not shown). Any other suitable means of coupling the linkage 321 to the bow 100 can be used. The horizontal and vertical positioning of the rest can be adjusted by making adjustments to the coupling of the linkage 321 with respect to the bow 100, for example, as shown in FIG. 1.

Figure 8:
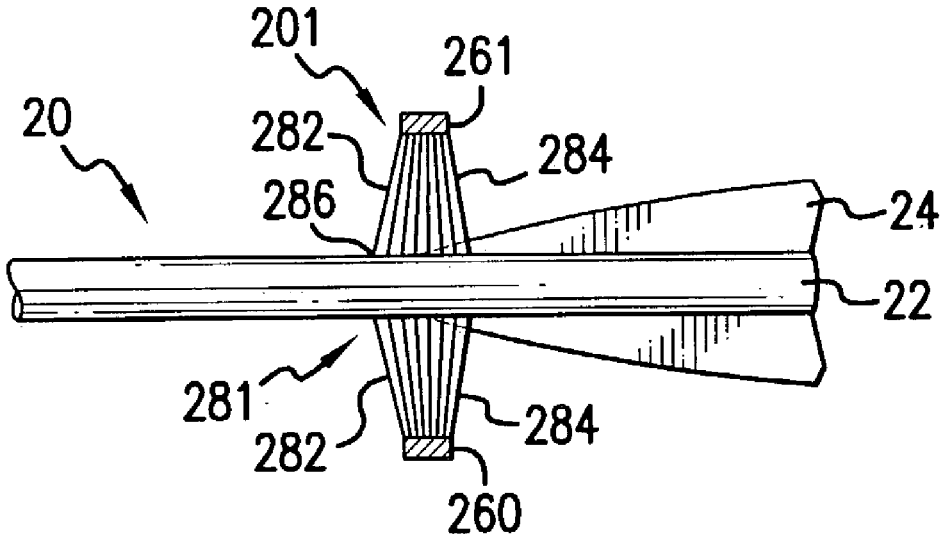
FIG. 8 is a cross-sectional view of an arrow disposed within the arrow rest according to an embodiment of the present invention in a ready-to-draw position.

Referring now to FIG. 8, a cross-sectional view of an arrow 20 disposed within the ring 261 according to an embodiment of the present invention in a ready-to-draw position is shown. The pliable member 281 includes a layer of front-facing bristles 282 and a layer of rear-facing bristles 284. Preferably, a length of the front-facing bristles 282 is equal to a length of the rear-facing bristles 284.

Preferably, the length of the front-facing bristles and the rear-facing bristles measure approximately 0.50 inches in length. Alternatively, any other suitable length of the front-facing bristles 282 and the rear-facing bristles 284 can be used. For example, in one embodiment, the lengths of the front-facing bristles 282 and the rear-facing bristles 284 can be different. In another embodiment, there may be no bristles where the fletch 24 of the arrow 20 passes through the ring 261.

Figure 9:
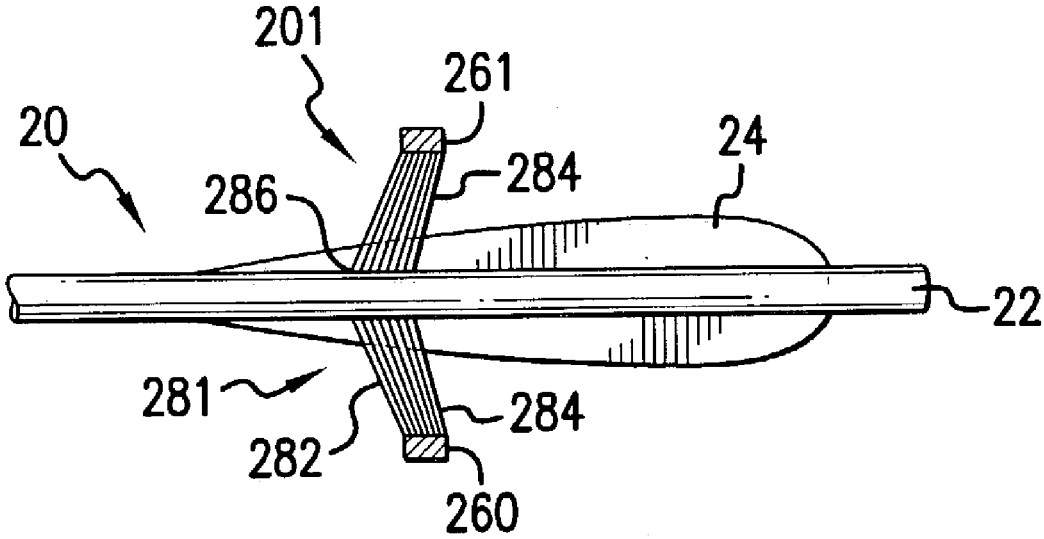
FIG. 9 is a cross-sectional view of an arrow disposed within the arrow rest according to an embodiment of the present invention as it is being projected through the arrow rest.

Referring now to FIG. 9, a cross-sectional view of an arrow 20 disposed within the ring 261 according to an embodiment of the present invention as it is being projected through the ring 261 is shown. When arrow 20 is projected through pliable member 281, the front-facing bristles 282 and the rear-facing bristles 284 are directed in a direction of arrow 20 travel as shown in FIG. 9. After the arrow 20 is projected through the ring 261, front-facing bristles 282 and rear-facing bristles 284 return back substantially to their original position as shown in FIG. 8.

Figure 10:
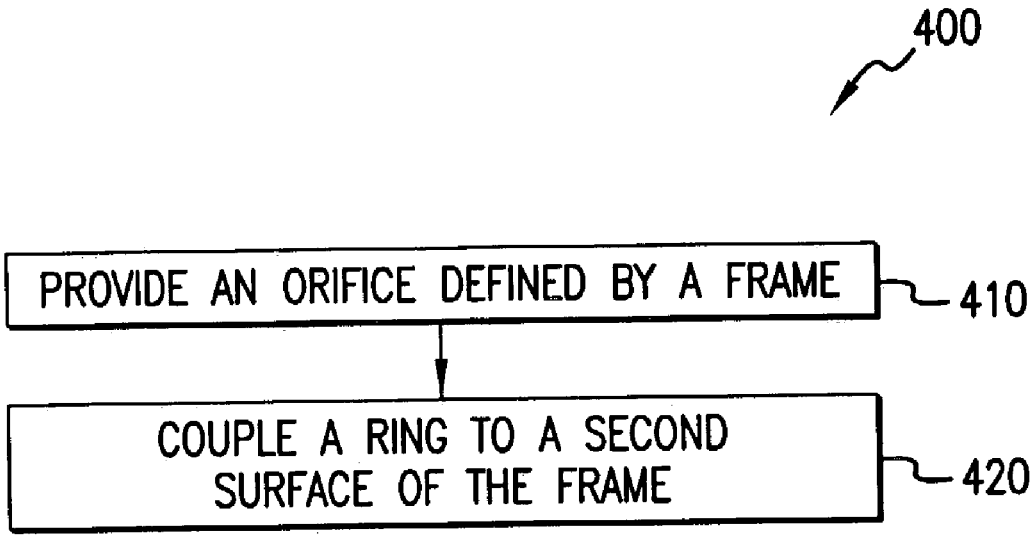
FIG. 10 is a block diagram of a method according to an embodiment of the present invention.

Referring now to FIG. 10, a method 400 according to an embodiment of the present invention is shown. The method 400 may be employed in the system 10 described above, and items shown in FIGS. 1–9 are referred to in describing FIG. 10 to aid understanding of the embodiment 400 shown. However, embodiments of methods according to the present invention are not limited to the embodiments described above and shown in FIGS. 1–9, but may be employed in a wide variety of arrow rests.

Referring to FIG. 10, block 410 indicates that an orifice defined by a frame is provided. As discussed above, the frame is preferably arcuate shaped and is adapted to receive a ring. Alternatively, the frame can be any other suitable shape. The frame includes a first axis, a slot, and a plurality of surfaces, including a first surface, a second surface, and a ridge surface.

The embodiment of the frame can be similar to that described above with reference to FIGS. 1–9. Preferably, the slot is positioned 45 degrees from the first axis. In one embodiment, the slot can be positioned planar with the first axis. In another embodiment, the axis can be positioned perpendicular to the first axis. Alternatively, the slot can be disposed in any other suitable position, as described above.

Block 420 shows that a ring is coupled to the second surface of the frame. Preferably, the ring is disposed within the frame. A pliable member is disposed within the ring. Preferably, a continuous aperture is defined by the pliable member. Alternatively, the pliable member defines a substantially continuous aperture. Preferably, the aperture is circular. Alternatively, any other suitable shape that can support an arrow shaft can be used.

FIGS. 11–15 show an alternate embodiment of a frame 510 of the arrow rest according to the present invention. Elements similar to the embodiment described above will not be repeated. FIGS. 11 and 12 are elevation views of ring 510. FIG. 13 is a side view of FIG. 11. FIGS. 14 and 15 are cross-sectional views of first portion 530. The same cross-sections are present on second portion 540. To facilitate description of this alternate embodiment, a pliable member is not shown in FIGS. 11–13.

A difference between the first embodiment and this alternate embodiment is base element 570. As shown in FIGS. 11 and 12, a portion of base element 570 is arcuate shaped similar to first and second portions 530, 540. Base element 570 is disposed at an angle with respect to first and second axes I and II. Preferably, base element 570 is disposed at an angle of 45 degrees with respect to axes I and II. Alternatively, base element 510 can be disposed in any other suitable configuration. Frame 510 is coupled with a second base member (not shown) employing the principles with reference to the first embodiment discussed above. Moreover, the rest is coupled to bow 100 employing the principles of the invention discussed above.

Figure 18:
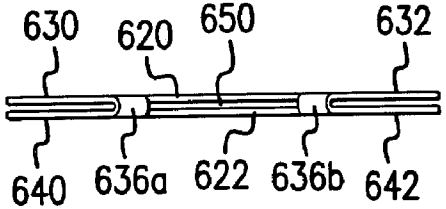
FIG. 18 is a top view of the frame of FIG. 17.
Figure 17:
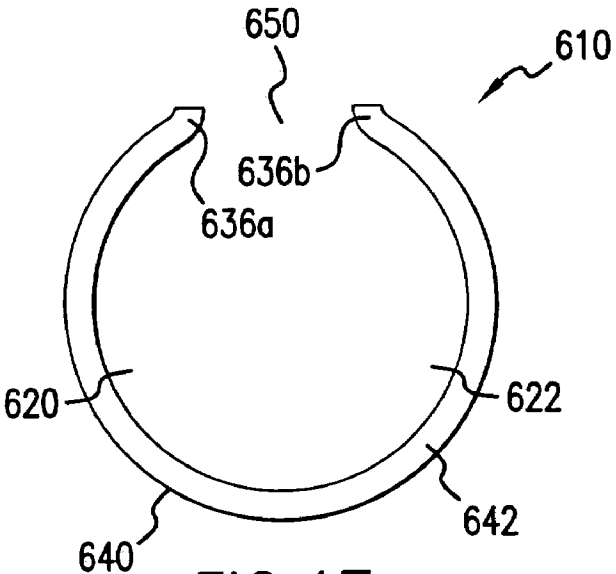
FIG. 17 is a side view of the frame of the arrow rest of FIG. 16.
Figure 16:
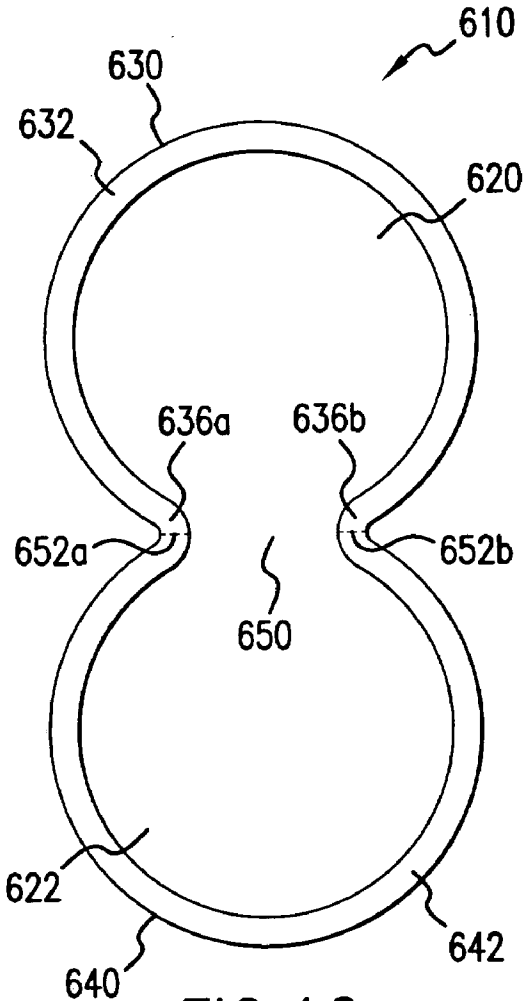
FIG. 16 is a side view of another embodiment of a frame of an arrow rest for either a left or a right-handed application according to the present invention.

Referring now to FIGS. 16–18, another alternate embodiment of a frame 610 of an arrow rest according to the principles of the invention is shown. FIG. 16 shows a side view of the frame 610 when it is stamped. Preferably, frame 610 resembles a "figure 8" when stamped. Alternatively, any other suitable shape or configuration can be used. Preferably, frame 610 is made of a light-weight metal, such as aluminum. Alternatively, frame 610 can be made of any other suitable material. Frame 610 includes a first portion 630, a second portion 640, ends 636*a*, 636*b* and slot 650.

Preferably, first and second portions 630, 640 each form a semicircular shape. First portion 630 defines first orifice 620 and second portion 640 defines second orifice 622. First portion 630 includes a first surface 632 and a second surface (not shown). First surface 632 and second surface are disposed on opposing sides of first portion 630. First portion 630 contacts second portion 640 at a junction 652*a*, 652*b*. A gap formed by ends 636*a*, 636*b* defines slot 650.

Second portion 640 includes a first surface 642 and a second surface (not shown). First surface 642 and second surface are disposed on opposing sides of second portion 640. Second portion 640 defines a second orifice 622.

Referring now to FIG. 17, a side view of the frame 610 is shown. The frame 610 shown in FIG. 17 is formed by folding the frame 610 shown in FIG. 16 along the dotted lines along junction 652*a*, 652*b*. The side view shown in FIG. 17 shows second portion 640. Although not visible, in facing opposition to second portion 640 is first portion 630.

Referring now to FIG. 18, a top view of the frame 610 shown in FIG. 17 is shown. When folded as shown in FIGS. 17 and 18, frame 610 is adapted to receive a ring (not shown), for example, as that described above with reference to FIGS. 1–9. Alternatively, frame 610 is adapted to receive any other suitable ring.

Preferably, the ring is secured in frame 610 by pinching or pressing first portion 630 and second portion 640 together so that frame 610 is plastically deformed. Alternatively, first and second portions 630, 640 can be secured by a clip, fastener, or any other suitable connecting means.

Frame 610 is preferably coupled to bow 100 by inserting the frame 610 and the ring into a trench formed in a base member, such as, for example, trench 312*a* formed in base member 311, as described above with reference to FIG. 7. Alternatively, frame 610 can be coupled to any other suitable base member. Once inserted, the frame 610 is secured to the base member with screw-type fasteners. Alternatively, the frame 610 can be secured to the base member using any other suitable means. The embodiment described with respect to FIGS. 16–18 can be used with either left or right-handed applications without modification. Furthermore, frame 610 is capable of being rotated in the base member to any desired angle.

Figure 19:
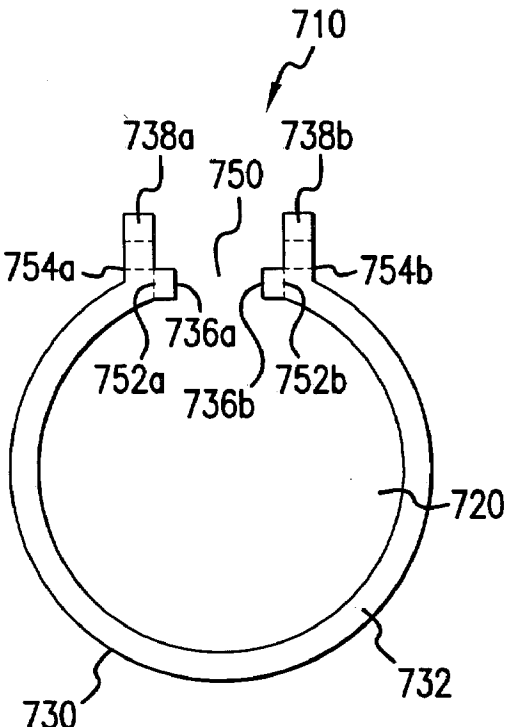
FIG. 19 is a side view of another embodiment of a frame of an arrow rest for either a left or a right-handed application according to the present invention.

Referring now to FIG. 19, another alternate embodiment of a frame 710 of an arrow rest according to the principles of the invention is shown. FIG. 19 shows a side view of the frame 710 when it is stamped. Preferably, frame 710 is made of a light-weight metal, such as aluminum. Alternatively, frame 710 can be made of any other suitable material. Frame 710 includes a first portion 730 and slot 750. Frame 710 is semicircular and defines orifice 720.

A gap formed by ends 736*a*, 736*b* defines slot 750. In one embodiment, felt, or any other suitable sound-dampening material can be coupled to ends 736*a*, 736*b*. As described above, the sound-dampening material helps reduce noise from an arrow contacting the arrow rest when being loaded.

Figure 21:
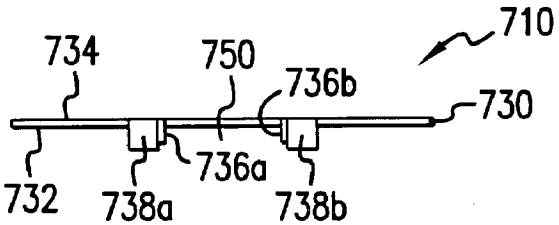
FIG. 21 is a top view of the frame shown in FIG. 20.

First portion 730 includes a first surface 732 and a second surface 734 (see FIG. 21). First surface 732 and second surface 734 are on opposing sides of first portion 730. Extending from first portion 730 proximate ends 736*a*, 736*b* are tabs 738*a*, 738*b*. Ends 736*a*, 736*b* and tabs 738*a*, 738*b* are disposed substantially perpendicular to one another. Alternatively, ends 736*a*, 736*b* and tabs 738*a*, 738*b* can be disposed in any other suitable configuration.

Figure 20:
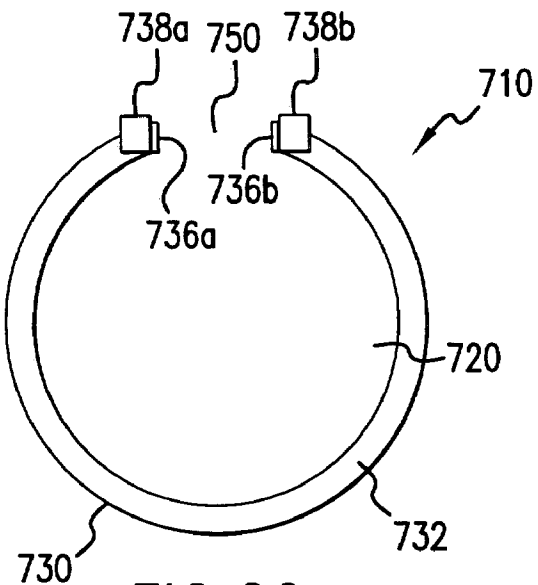
FIG. 20 is a side view of the frame of the arrow rest of FIG. 19.

FIGS. 20 and 21 show frame 710 when ends 736*a*, 736*b* are folded along end junctions 752*a*, 752*b* and tabs 738*a*, 738*b* are folded along tab junctions 754*a*, 754*b*. Ends 736 and tabs 738 are folded so that they are plastically deformed. As shown in FIG. 19, tabs 738*a*, 738*b* are folded in three segments indicated by the dashed lines. Each of the segments of tabs 738*a*, 738*b* is substantially perpendicular to its adjacent segment. The resulting shape of folded tabs 738*a*, 738*b* resembles a u-shaped channel. Thus, ends 736*a*, 736*b* and tabs 738*a*, 738*b* are folded so that the frame 710 can securely hold a ring (not shown) in place. In other embodiments, a different number of tabs may be used. Any other suitable ring can be used.

Frame 710 is preferably coupled to bow 100 by inserting the frame 710 and the ring into a trench formed in a base member, such as, for example, trench 312*a* formed in base member 311, as described above with reference to FIG. 7. Alternatively, frame 710 can be coupled to any other suitable base-member. Once inserted, the frame 710 is secured to the base member with screw-type fasteners. Alternatively, the frame 710 can be secured to the base member using any other suitable means. The embodiment described with respect to FIGS. 19 and 20 can be used in either left or right-handed applications without modification. Furthermore, frame 710 is capable of being rotated in the base member to any desired angle.

Figure 24:
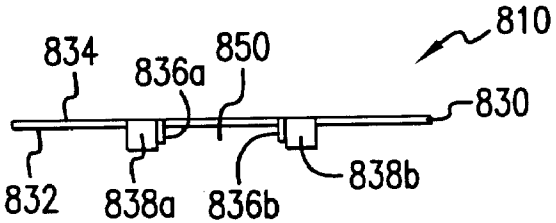
FIG. 24 is a top view of the frame shown in FIG. 23.
Figure 23:
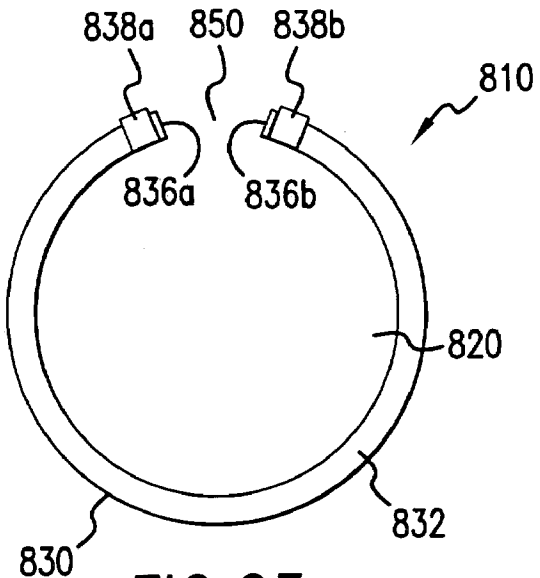
FIG. 23 is a side view of the frame of the arrow rest of FIG. 22.
Figure 22:
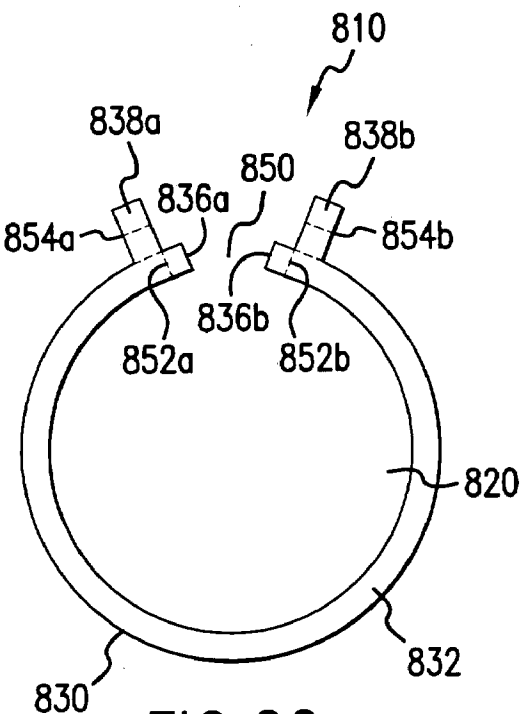
FIG. 22 is a side view of another embodiment of a frame of an arrow rest for either a left or a right-handed application according to the present invention.

Referring now to FIGS. 22–24, an alternate embodiment of frame 810 of an arrow rest according to the principles of the invention is shown. Specifically, FIGS. 22–24 show an alternate embodiment of frame 710, described above and shown in FIGS. 19–21. Like elements will not be repeated. FIG. 22 shows a side view of the frame 810 when it is stamped. FIG. 23 shows a side view of the frame 810 when ends 836*a*, 836*b* and tabs 838*a*, 838*b*. FIG. 24 shows a top view of FIG. 23.

A difference between the embodiment of ring 710 and ring 810 is the positioning of ends 836*a*, 836*b* and tabs 838*a*, 838*b*. An angle formed by end 836*a* and tab 838*a* is approximately a right angle. End 838*a* is disposed substantially tangential to an outer surface of first portion 830. A similar configuration is present for end 836*b* and tab 838*b*. As shown in FIG. 23, this configuration can help guide an arrow into a desired position in the arrow rest.

While the present invention has been disclosed with reference to certain embodiments, numerous modifications, alterations, and changes to the described embodiments are possible without departing from the sphere and scope of the present invention, as defined by the appended claims. Accordingly, it is intended that the present invention not be limited to the described embodiments, but that it has the full scope defined by the language of the following claims, and equivalents thereof.

What is claimed is:

1. An apparatus comprising:

a frame adapted to be mounted to an archery bow, the frame comprising a slot;

a ring coupled with and disposed within the frame, the frame adapted to receive the ring; and a pliable member adapted to be received in the ring and to support an arrow shaft, the ring distinct from the pliable member.

2. An apparatus comprising:

a frame adapted to be mounted to an archery bow and to accommodate an arrow shaft, the frame comprising a slot and defining an orifice comprising an axis;

a ring coupled with and disposed within the frame, the frame adapted to receive the ring; and a pliable member adapted to be received in the ring and to support the arrow shaft, the ring distinct from the pliable member.

3. An apparatus comprising:

a frame adapted to be mounted to an archery bow and to accommodate an arrow shaft, the frame comprising a slot and defining an orifice comprising an axis, the slot positioned planar to the axis;

a ring coupled with and disposed within the frame, the frame adapted to receive the ring; and a pliable member adapted to be received in the ring and to support the arrow shaft, the ring distinct from the pliable member.

4. An apparatus comprising:

a frame adapted to be mounted to an archery bow, the frame comprising a slot and displaceable between a first position and a second position, the first position corresponding to a first dimension of the slot and the second position corresponding to a second dimension of the slot;

a ring coupled with the frame, the frame adapted to receive the ring; and a pliable member adapted to be received in the ring and to support an arrow shaft, the ring distinct from the pliable member.

5. A method comprising:

providing a frame adapted to be mounted to an archery bow, the frame comprising a slot;

coupling a ring to the frame, the frame adapted to accept the ring, wherein the ring is adapted to receive a pliable member adapted to support an arrow shaft, the ring distinct from the pliable member; and disposing the ring within the frame.

6. A method comprising:

providing a frame adapted to be mounted to an archery bow and to accommodate an arrow shaft, the frame comprising a slot and defining an orifice comprising an axis; and coupling a ring to and disposing said ring within the frame, the frame adapted to accept the ring, wherein the ring is adapted to receive a pliable member adapted to support the arrow shaft, the ring distinct from the pliable member.

7. A method comprising:

providing a frame adapted to be mounted to an archery bow and to accommodate an arrow shaft, the frame comprising a slot and defining an orifice comprising an axis;

coupling a ring to and disposing said ring within the frame, the frame adapted to accept the ring, wherein the ring is adapted to receive a pliable member adapted to support the arrow shaft, the ring distinct from the pliable member; and positioning the slot planar to the axis.

8. A system comprising:

an archery bow;

a base member coupled to the bow; and an arrow rest coupled to the base member, the arrow rest comprising:

a frame defining an orifice, the frame comprising a slot;

a ring coupled with the frame, the frame adapted to accept the ring; and a pliable member coupled with the ring, the pliable member adapted to support an arrow shaft, the ring distinct from the pliable member.

9. The system of claim 8, wherein the ring is disposed within the frame.

10. The system of claim 8, wherein an aperture is disposed within the ring.

11. The system of claim 10, wherein the aperture comprises a circular shape.

12. The system of claim 8 wherein the frame defines an orifice comprising an axis.

13. The system of claim 12, wherein the slot is positioned planar to the axis.

14. The system of claim 12, wherein the slot is positioned 45 degrees from the axis.

15. The system of claim 8, wherein the frame is displaceable between a first position and a second position, the first position corresponding to a first dimension of the slot.

16. An apparatus comprising:

a frame adapted to be mounted to an archery bow and to accommodate an arrow shaft, the frame defining an orifice and comprising a slot, the frame adapted to receive a ring, wherein the ring is adapted to receive a pliable member adapted to support the arrow shaft, the ring distinct from the pliable member and wherein the ring is coupled with and disposed within the frame.

17. The apparatus of claim 16, wherein the ring is disposed within the frame.

18. The apparatus of claim 16, the frame further comprising:

a base; and first and second portions extending from the base.

19. The apparatus of claim 18, wherein the first and second portions are arcuate-shaped.

20. The apparatus of claim 18, wherein the first portion comprises a first end and a second portion comprises a second end, the first and second portions in facing opposition to one another.

21. The apparatus of claim 20, wherein the first portion comprises a first thickness and a second thickness, the second thickness greater than the first thickness.

22. The apparatus of claim 20, wherein the first end and the second end define the slot.

23. The apparatus of claim 22, further comprising a gate comprising a first end adapted to be coupled to the second end of the second portion, the gate adapted to span the slot.

24. The apparatus of claim 16, wherein the frame defines an orifice comprising an axis.

25. The apparatus of claim 24, wherein the slot is positioned planar to the axis.

26. The apparatus of claim 24, wherein the slot is positioned 45 degrees from the axis.

27. The apparatus of claim 16, wherein the frame comprises a polymer.

28. The apparatus of claim 27, wherein the polymer comprises a glass-filled nylon.

29. The apparatus of claim 16, wherein the frame comprises a machined aluminum.

30. The apparatus of claim 16, wherein at least one of a first arm and a second arm is displaceable between a first position and a second position, the first position corresponding to a first dimension of the slot and the second position corresponding to a second dimension of the slot.

31. An apparatus comprising:

a frame adapted to be mounted to an archery bow, the frame comprising a slot and defining an orifice comprising an axis, the slot positioned 45 degrees from the axis;

a ring coupled with the frame, the frame being adapted to receive the ring; and a pliable member adapted to be received in the ring and to support an arrow shaft, the ring distinct from the pliable member.

32. An apparatus comprising:

a frame adapted to be mounted to an archery bow, the frame comprising a slot and a first portion comprising a first end and a second portion comprising a second end, the first end and the second end defining the slot;

a ring coupled with the frame, the frame adapted to receive the ring; and a pliable member adapted to be received in the ring and to support an arrow shaft, the ring distinct from the pliable member.

33. An apparatus comprising:

a frame adapted to be mounted to an archery bow, the frame comprising a slot and a first portion comprising a first end and a second portion comprising a second end, the first end and the second end defining the slot;

a ring coupled with the frame, the frame adapted to receive the ring; and a pliable member adapted to be received in the ring and to support an arrow shaft, the ring distinct from the pliable member, wherein the first portion comprises a first thickness and a second thickness, the second thickness greater than the first thickness.

34. An apparatus comprising:

a frame adapted to be mounted to an archery bow, the frame comprising a slot and a first portion comprising a first end and a second portion comprising a second end, the first end and the second end defining the slot;

a ring coupled with the frame, the frame adapted to receive the ring;

a pliable member adapted to be received in the ring and to support an arrow shaft, the ring distinct from the pliable member; and a gate comprising a first end adapted to be coupled to the first end of the first portion, the gate adapted to span the slot.

35. A method comprising:

providing a frame adapted to be mounted to an archery bow, the frame comprising a slot and defining an orifice comprising an axis;

positioning the slot 45 degrees from the axis; and coupling a ring to the frame, the frame adapted to accept the ring, wherein the ring is adapted to receive a pliable member adapted to support an arrow shaft, the ring distinct from the pliable member.

* * * * *